US006485587B1

(12) United States Patent
Han et al.

(10) Patent No.: US 6,485,587 B1
(45) Date of Patent: Nov. 26, 2002

(54) COATING PROCESS FOR PLASTIC BONDED EXPLOSIVE

(75) Inventors: Philip S. Han, Issue, MD (US); David Jordan, Coleford (GB)

(73) Assignee: The United States of America as represented by The Secretary of the Navy, Washington, DC (US)

( * ) Notice: Subject to any disclaimer, the term of this patent is extended or adjusted under 35 U.S.C. 154(b) by 256 days.

(21) Appl. No.: 09/697,243

(22) Filed: Oct. 27, 2000

(51) Int. Cl.[7] ..... C06B 45/10; D03D 23/00
(52) U.S. Cl. ..... 149/19.92; 149/109.6
(58) Field of Search ..... 149/19.92, 88, 149/92, 109.6; 264/3.4

(56) References Cited

U.S. PATENT DOCUMENTS

| | | | | | |
|---|---|---|---|---|---|
| 4,168,191 | A | | 9/1979 | Benziger | 149/19.91 |
| 4,482,405 | A | | 11/1984 | Wright | 149/19.3 |
| 4,952,255 | A | | 8/1990 | Stanton | 149/19.91 |
| 5,067,996 | A | * | 11/1991 | Lundstrom et al. | 149/19.4 |
| 5,547,526 | A | * | 8/1996 | Wanninger et al. | 149/19.2 |
| 5,565,150 | A | | 10/1996 | Dillehay et al. | 264/3.3 |
| 5,565,651 | A | | 10/1996 | Kim et al. | 149/19.92 |
| 5,600,088 | A | | 2/1997 | Oberth | 149/11 |
| 5,712,511 | A | * | 1/1998 | Chan et al. | 264/3.4 |
| 5,750,921 | A | | 5/1998 | Chan et al. | 149/19.92 |
| 6,217,799 | B1 | * | 4/2001 | Lee et al. | 264/3.3 |

OTHER PUBLICATIONS

PBXW–9 Explosive Molding Powder Scaleup, Mark D. Lowell, Mar. 29, 1990.

* cited by examiner

*Primary Examiner*—Michael J. Carone
*Assistant Examiner*—Aileen J. Baker
(74) *Attorney, Agent, or Firm*—Mark Homer

(57) ABSTRACT

A method of making a batch of explosive molding powder including preparing a lacquer comprising an organic solvent, a binder and if required, a plasticizer; adding water to a kettle; adding explosive material to the kettle; adding the lacquer to the kettle; heating contents of the kettle to above 98 degrees C.; cooling the contents of the kettle to below about 55; separating the water from the explosive material; and drying the explosive material to form the explosive molding powder.

18 Claims, No Drawings

COATING PROCESS FOR PLASTIC BONDED EXPLOSIVE

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to plastic bonded explosive molding powder and in particular to an improved coating process for plastic bonded explosive molding powder.

Traditional water slurry methods for producing explosive molding powder have been used for over 40 years in explosive production facilities. Even when a high quality molding powder is produced by the traditional water slurry method, uncoated explosive particles remain in the batch. These uncoated explosive particles damage the sensitivity characteristics of the explosive molding powder.

Plastic bonded explosive molding powder is typically made in a batch process. A polymer is dissolved in an organic solvent to form a lacquer. The lacquer is mixed with a high explosive solid in a slurry kettle filled with water. After the lacquer is transferred to the mixture, the temperature is raised to distil off the solvent. The slurry is cooled and the batch is dewatered and then dried.

In known coating processes, granulation of the molding powder occurs during the addition of the lacquer, or by the addition of quench water after addition of the lacquer, and it is very difficult, if not impossible, to uniformly coat all of the explosive material surface with binder. Therefore, there exists a need for a coating process that results in a more uniform coating of all sizes of explosive material particles.

SUMMARY OF THE INVENTION

The present invention provides a method of making a batch of explosive molding powder comprising preparing a lacquer comprising an organic solvent, a binder and, if required by the explosive formulation, a plasticizer; adding water to a kettle; adding explosive material to the kettle; adding the lacquer to the kettle; heating contents of the kettle to above 98 degrees C.; cooling the contents of the kettle to below about 55 C.; separating the water from the explosive material; and drying the explosive material to form the explosive molding powder.

Using the above method, the present invention ensures that granulation of the molding powder is delayed until some of the solvent is removed by evaporation and/or distillation, thereby ensuring that all the explosive particles are coated with binder.

The present invention can be used to manufacture, or rework, any of the explosive formulations made by traditional methods, the binder to plasticizer ratio being predetermined by existing explosive material specifications.

Preferably, the organic solvent comprises ethyl acetate or methyl ethyl ketone, the binder and the plasticizer are in accordance with the explosive specification and may be selected by those skilled in the art. A ratio of an amount of solvent to binder is in the range of about 24:1 to about 90:1. A ratio of an amount of water to explosive batch is in the range of about 4:1 to about 8:1, the preferred amount of water being dependent upon the size of granulation required for the molding powder.

The explosive ingredients and the lacquer are then added to a kettle and agitated. Depending upon the explosive formulation being produced, the agitation may occur at ambient temperature. However, for certain explosive formulations, an agitator speed, for example 45 rpm, is established prior to adding any material to the kettle. The explosive material is then added and agitated at ambient temperature for a time period which is dependent upon the explosive formulation. The kettle is heated to from about 53 degrees C. to about 62 degrees C. and higher agitator speed is then established, for example 70 rpm, and the lacquer is added to the kettle and the mixture is agitated for a time dependent upon the explosive formulation. For reworking batches, either for granulation and/or composition, the lacquer is added to the kettle at ambient temperature to prevent excessive deposits on the wall of the vessel.

The mixture is then heated to about 98 degrees C. for about 10 to about 30 minutes. The mixture is then cooled to below about 55 degrees C. During the cooling step, the agitator speed is slowed, for example to about 50 rpm. The mixture is then dried until explosive material moisture content is less than about 0.1%.

Further objects, features and advantages of the invention will become apparent from the following detailed description.

DETAILED DESCRIPTION OF THE PREFERRED EMBODIMENTS

The present invention includes a new coating process for producing high coating quality molding powder. The presence of uncoated explosive particles is minimized as are batch-to-batch variations. Explosive molding powder produced by the invention showed the following advantages:

1. Better and more reliable coating quality.
2. A decrease in the amount of uncoated particles, particularly uncoated fine particles.
3. Improvement in safety characteristics because of eliminating or minimizing uncoated particles.
4. No dusting problem during pressing operations because of eliminating or minimizing uncoated fine particles.
5. More reproducible, simpler manufacturing process with a lower reject rate.
6. More consistent material characteristics, such as bulk density and powder internal frictional coefficient.

The inventive process includes the following steps:

1) The first step in the process of making explosive molding powder is to make a lacquer. The lacquer for coating explosive molding powder is a mixture of an organic solvent, a binder and if required, a plasticizer. The ratio of the amount of solvent to binder is in the range of about 24:1 to about 90:1. The solvent is poured into a first kettle having an agitator. The binder and plasticizer are added and the ingredients are agitated until the binder has dissolved.

2) The second step in the process is to add water. The water is added to a second kettle with an agitator. The second kettle includes a steam, or oil heating jacket, and a condenser system such that the organic solvent may either be refluxed or distilled. The water to batch ratio is in the range of about 4:1 to about 8:1. "Batch" is defined as the amount of explosive material plus the amount of binder plus the amount of any required plasticizer.

3) The required amount of explosive material is added to the water in the second kettle and agitated at ambient temperature (around 23 degrees Centigrade) for about 10 minutes to about 30 minutes dependent upon the explosive formulation. Numerous explosive materials can be used in this process, for example RDX (Cyclotrimethylenetrinitramine) or HMX (Cyclotetramethylenetetranitramine), and can be selected by those skilled in the art.

4) If required for the explosive formulation, the vessel is heated to from about 53 degrees C. to about 62 degrees C. This brings the temperature of the slurry in the second kettle to from about 50 degrees C. to about 64 degrees C.

5) The lacquer is added over from about 10 minutes to about 30 minutes to the second kettle at a temperature from about ambient to about 65 degrees C. and the slurry is then agitated for about 30 to about 60 minutes.

6) The slurry in the second kettle is slowly heated until the temperature is greater than 98 degrees C. Granulation of the explosive material is achieved during this heating step.

7) The temperature is maintained above 98 degrees C. for about 10 to about 30 minutes to finish distilling off the solvent.

8) The slurry is then cooled to below about 55 degrees C.

9) The water is separated from the explosive material by, for example, discharging the slurry through a valve in the bottom of the kettle and filtering the slurry to remove the explosive material.

10) If desired, the explosive material may be washed with water to remove any remaining solvent.

11) The explosive material is placed in trays and dried in an oven until the moisture content is less than about 0.1%.

The following examples illustrate the process set forth above.

EXAMPLE #1

A batch of PBXN-7 explosive molding powder was made. The batch size was 1,540 pounds (explosive material plus binder). One thousand, one hundred and sixty eight pounds of methyl ethyl ketone was used as the solvent to prepare the lacquer. Seventy seven pounds of Fluorel, a fluoroelastomer, was used as the binder.

A 300 gallon kettle with an anchor blade agitator was used to prepare the lacquer. The methyl ethyl ketone and Fluorel were added to the kettle and agitated for 18 hours at ambient temperature.

A 2,500 gallon kettle fitted with a turbine blade agitator, a solvent condenser system and a steam heated jacket, was used to prepare the explosive molding powder. Demineralised water in the amount of 11,528 pounds was added to the kettle (water to batch ratio 7.47:1). The agitator speed was brought up to 50 to 55 rpm and the explosive material, 924 pounds of TATB (triaminotrinitrobenzene) Class 1 and 539 pounds of RDX (cyclotrimethylenetrinitramine) Class 5, was added. The speed of the agitator was increased to 70 rpm and the slurry was agitated at 70 to 75 rpm for 10 minutes at ambient temperature.

The condenser system on the vessel was set to reflux and the slurry was heated to 62 degrees C. The previously prepared lacquer was added to the slurry, over a period of 10 to 30 minutes. A further eight hundred and sixteen pounds of methyl ethyl ketone was added to the slurry (total solvent to binder ratio 25.7:1). The slurry was agitated at 70 rpm for 30 minutes at 60 to 64 degrees C.

The condenser system on the kettle was then switched to distil and the slurry heated to 78 degrees C. The slurry was agitated at 70 rpm for 60 minutes at 78 to 80 degrees C. Over a period of about 60 minutes, the temperature of the slurry was brought up to 98 degrees C. while still agitating at 70 rpm. The temperature was maintained above 98 degrees C. for about 10 minutes to finish distilling the solvent.

The agitator was slowed to 50 to 55 rpm and the slurry was cooled to 55 degrees C. The bottom valve of the kettle was opened and the slurry was discharged through a filter to separate the water from the explosive material. The explosive material was washed with water for about 10 minutes to remove any traces of solvent.

The explosive material was placed in trays and dried in an oven for about 30 hours at 55 degrees C. until the moisture content was less than 0.1%.

The final composition of the 1,540 pound batch was 60% TATB Class 1, 35% RDX Class 5 and 5% fluoroelastomer.

EXAMPLE #2

A batch of PBXN-7 explosive molding powder was reworked for granulation. The batch size was 1,540 pounds of explosive material.

A 2,500 gallon kettle fitted with a turbine blade agitator, a solvent condenser system and a steam heated jacket, was used to rework the explosive molding powder. Demineralised water in the amount of 11,528 pounds was added to the kettle (water to batch ratio 7.47:1). The agitator speed was brought up to 50 to 55 rpm and the explosive material, PBXN-7, was added. The speed of the agitator was increased to 70 rpm and the slurry was agitated at 70 to 75 rpm for 10 minutes at ambient temperature.

The condenser system on the vessel was set to reflux. One thousand, nine hundred and eighty four pounds of methyl ethyl ketone was added to the slurry (solvent to binder ratio 25.7:1) over a period of 10 to 30 minutes. The slurry was agitated at 70 rpm for 30 minutes at ambient temperature.

The slurry was heated to 62 degrees C. and then agitated at 70 rpm for 30 minutes at 60 to 64 degrees C.

The condenser system on the kettle was then switched to distil and the slurry heated to 78 degrees C. The slurry was agitated at 70 rpm for 60 minutes at 78 to 80 degrees C. Over a period of about 60 minutes, the temperature of the slurry was brought up to 98 degrees C. while still agitating at 70 rpm. The temperature was maintained above 98 degrees C. for about 10 minutes to finish distilling the solvent.

The agitator was slowed to 50 to 55 rpm and the slurry was cooled to 55 degrees C. The bottom valve of the kettle was opened and the slurry was discharged through a filter to separate the water from the explosive material. The explosive material was washed with water for about 10 minutes to remove any traces of solvent.

The explosive material was placed in trays and dried in an oven for about 30 hours at 55 degrees C. until the moisture content was less than 0.1%.

Prior to reworking the PBXN-7 granulation was 81.8% passing through #14 sieve, 54.6% passing through a #18 sieve and 2.1% passing through a #100 sieve. After reworking the PBXN-7 granulation was 97.0% passing through #14 sieve, 52.4% passing through a #18 sieve and 0.0% passing through a #100 sieve.

EXAMPLE #3

A batch of PBXN-7 explosive molding powder that was low in %TATB was reworked to correct the composition. The batch size was 1,587 pounds of explosive material.

A 2,500 gallon kettle fitted with a turbine blade agitator, a solvent condenser system and a steam heated jacket, was used to prepare the explosive molding powder. Demineralised water in the amount of 12,038 pounds was added to the kettle (water to batch ratio 7.59:1). The agitator speed was brought up to 50 to 55 rpm and the explosive material, 1540 pounds of PBXN-7 and 47 pounds of TATB, was added. The speed of the agitator was increased to 70 rpm and the slurry was agitated at 70 to 75 rpm for 10 minutes at ambient temperature.

The condenser system on the vessel was set to reflux. Two thousand and seventy two pounds of methyl ethyl ketone was added to the slurry (solvent to binder ratio 27.4:1) over a period of 10 to 30 minutes. The slurry was agitated at 70 rpm for 30 minutes at ambient temperature.

The slurry was heated to 62 degrees C. and then agitated at 70 rpm for 30 minutes at 60 to 64 degrees C.

The condenser system on the kettle was then switched to distil and the slurry heated to 78 degrees C. The slurry was agitated at 70 rpm for 60 minutes at 78 to 80 degrees C. Over a period of about 60 minutes, the temperature of the slurry was brought up to 98 degrees C. while still agitating at 70 rpm. The temperature was maintained above 98 degrees C. for about 10 minutes to finish distilling the solvent.

The agitator was slowed to 50 to 55 rpm and the slurry was cooled to 55 degrees C. The bottom valve of the kettle was opened and the slurry was discharged through a filter to separate the water from the explosive material. The explosive material was washed with water for about 10 minutes to remove any traces of solvent.

The explosive material was placed in trays and dried in an oven for about 30 hours at 55 degrees C. until the moisture content was less than 0.1%.

Prior to reworking the composition of the PBXN-7 was 58.5% TATB. After reworking the composition of the PBXN-7 was 60.0% TATB.

EXAMPLE #4

Three batches of PBXN-9 explosive molding powder were made.

For each batch, the batch size was 1,540 pounds (explosive material plus binder plus plasticizer). One thousand and fifteen pounds of ethyl acetate was used as the solvent to prepare the lacquer. Thirty one pounds of Hytemp 4454, a polyacrylic elastomer, was used as the binder (solvent to binder ratio 32.9:1). Ninety three pounds of Di (2-ethylhexyl)-adipate (DOA) was used as the plasticizer (plasticizer to binder ratio 3:1).

A 300 gallon kettle with an anchor blade agitator was used to prepare the lacquer. The ethyl acetate, Hytemp 4454 and DOA were added to the kettle and agitated for 18 hours at ambient temperature.

A 2,500 gallon kettle fitted with a turbine blade agitator, a solvent condenser system and a steam heated jacket, was used to prepare the explosive molding powder. Demineralised water in the amount of 11,574 pounds, 9,259 pounds and 7,716 pounds, was added respectively to the kettle for each of the three batches (water to batch ratio 7.5:1, 6:1 and 5:1). The agitator speed was brought up to 50 to 55 rpm and 1,417 pounds of HMX (cyclotetramethylenetetranitramine) explosive material was added. The HMX comprised a mixture of Class 1 and Class 5 grists at a ratio of 55:45 Class 1 to Class 5. The speed of the agitator was increased to 70 rpm and the slurry was agitated at 70 rpm for 30 minutes at ambient temperature.

The condenser system on the vessel was set to reflux and the slurry was heated to 52 degrees C. The previously prepared lacquer was added to the slurry, over a period of 10 to 30 minutes. The slurry was agitated at 70 rpm for 30 minutes at 50 to 55 degrees C.

The condenser system on the kettle was then switched to distil and over a period of about 90 minutes, the temperature of the slurry was brought up to 98 degrees C. while still agitating at 70 rpm. The temperature was maintained above 98 degrees C. for about 15 minutes to finish distilling the solvent.

The agitator was slowed to 50 to 55 rpm and the slurry was cooled to 55 degrees C. The bottom valve of the kettle was opened and the slurry was discharged through a filter to separate the water from the explosive material. The explosive material was washed with water for about 10 minutes to remove any traces of solvent.

The explosive material was placed in trays and dried in an oven for about 30 hours at 55 degrees C. until the moisture content was less than 0.1%.

The final composition of all three 1,540 pound batches was 51% HMX Class 1, 41% HMX Class 5, 2% Hytemp 4454 and 6% DOA. The granulation of the batches, % passing through a #8 sieve, were 99, 92 and 90% respectively.

EXAMPLE #5

A batch of PBXN-9 explosive molding powder was made from a batch of PBXW-11.

The batch size was 1,540 pounds (explosive material plus binder plus plasticizer). One thousand and fifteen pounds of ethyl acetate was used as the solvent. Eleven pounds of Hytemp 4454, a polyacrylic elastomer, was used as the binder (solvent to total binder ratio 33:1). Twenty six pounds of Di (2-ethylhexyl)-adipate (DOA) was used as the plasticizer (plasticizer to binder ratio 3:1).

A 300 gallon kettle with an anchor blade agitator was used to prepare the lacquer. The ethyl acetate, Hytemp 4454 and DOA were added to the kettle and agitated for 18 hours at ambient temperature.

A 2,500 gallon kettle fitted with a turbine blade agitator, a solvent condenser system and a steam heated jacket, was used to prepare the explosive molding powder. Demineralised water in the amount of 4,630 pounds was added to the kettle. The agitator speed was brought up to 50 to 55 rpm and the explosive material, 1035 pounds of PBXW-11 and 435 pounds of HMX (cyclotetramethylenetetranitramine) Class 5, was added. The speed of the agitator was increased to 70 rpm and the previously prepared lacquer was added to the slurry, over a period of 10 to 30 minutes. The slurry was agitated at 70 rpm for 60 minutes at ambient temperature.

A further 3,086 pounds of demineralised water was added to the slurry (total water to batch ratio 5:1) and the slurry was agitated at 70 rpm for 30 minutes at ambient temperature.

The condenser system on the vessel was set to reflux and the slurry was heated to 57 degrees C. The slurry was agitated at 70 rpm for 30 minutes at 55 to 60 degrees C.

The condenser system on the kettle was then switched to distil and over a period of about 90 minutes, the temperature of the slurry was brought up to 98 degrees C. while still agitating at 70 rpm. The temperature was maintained above 98 degrees C. for about 15 minutes to finish distilling the solvent.

The agitator was slowed to 50 to 55 rpm and the slurry was cooled to 55 degrees C. The bottom valve of the kettle was opened and the slurry was discharged through a filter to separate the water from the explosive material. The explosive material was washed with water for about 10 minutes to remove any traces of solvent.

The explosive material was placed in trays and dried in an oven for about 30 hours at 55 degrees C. until the moisture content was less than 0.1%.

The final composition of the 1,540 pound batch was 51% HMX Class 1, 41% HMX Class 5, 2% Hytemp 4454 and 6% DOA.

EXAMPLE #6

A batch of PBXW-11 explosive molding powder was made.

The batch size was 1,540 pounds (explosive material plus binder plus plasticizer). One thousand and fifteen pounds of ethyl acetate was used as the solvent. Fifteen pounds of Hytemp 4454, a polyacrylic elastomer, was used as the binder (solvent to binder ratio 66:1). Forty six pounds of Di (2-ethylhexyl)-adipate (DOA) was used as the plasticizer (plasticizer to binder ratio 3:1).

A 300 gallon kettle with an anchor blade agitator was used to prepare the lacquer. The ethyl acetate, Hytemp 4454 and DOA were added to the kettle and agitated for 18 hours at ambient temperature.

A 2,500 gallon kettle fitted with a turbine blade agitator, a solvent condenser system and a steam heated jacket, was used to prepare the explosive molding powder. Demineralised water in the amount of 7,720 pounds was added to the kettle (water to batch ratio 5:1). The agitator speed was brought up to 50 to 55 rpm and 1,480 pounds of HMX (cyclotetramethylenetetranitramine) explosive material was added. The HMX comprised a mixture of Class 1 and Class 5 grists at a ratio of 76:20 Class 1 to Class 5. The speed of the agitator was increased to 70 rpm and the slurry was agitated at 70 rpm for 10 minutes at ambient temperature.

The condenser system on the vessel was set to reflux and the slurry was heated to 52 degrees C. The previously prepared lacquer was added to the slurry, over a period of 10 to 30 minutes. The slurry was agitated at 70 rpm for 30 minutes at 50 to 55 degrees C.

The condenser system on the kettle was then switched to distil and over a period of about 90 minutes, the temperature of the slurry was brought up to 98 degrees C. while still agitating at 70 rpm. The temperature was maintained above 98 degrees C. for about 15 minutes to finish distilling the solvent.

The agitator was slowed to 50 to 55 rpm and the slurry was cooled to 55 degrees C. The bottom valve of the kettle was opened and the slurry was discharged through a filter to separate the water from the explosive material. The explosive material was washed with water for about 10 minutes to remove any traces of solvent.

The explosive material was placed in trays and dried in an oven for about 30 hours at 55 degrees C. until the moisture content was less than 0.1%.

The final composition of the 1,540 pound batch was 76% HMX Class 1, 20% HMX Class 5, 1% Hytemp 4454 and 3% DOA.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method of making a batch of explosive molding powder, comprising:

preparing a lacquer comprising an organic solvent and a binder;

adding water to a kettle;

adding explosive material to the kettle;

adding the lacquer to the kettle;

heating contents of the kettle to above about 98 degrees C.;

cooling the contents of the kettle to below about 55 degrees C.;

separating the water from the explosive material; and drying the explosive material to form the explosive molding powder.

2. The method of claim 1, wherein the lacquer further comprises a plasticizer.

3. The method of claim 2, wherein the organic solvent is selected from the group comprising ethyl acetate and methyl ethyl ketone.

4. The method of claim 1, wherein a ratio of an amount of solvent to binder comprises a range of about 24:1 to about 90:1.

5. The method of claim 4, wherein the ratio of the amount of solvent to binder comprises about 60:1.

6. The method of claim 2, wherein a ratio of an amount of plasticizer to binder comprises about 3:1.

7. The method of claim 2, wherein the step of preparing the lacquer further comprises adding the organic solvent, the binder and the plasticizer to a kettle and agitating the lacquer at ambient temperature until the binder substantially dissolves.

8. The method of claim 1, wherein a ratio of the water to the batch comprises a range of about 4:1 to about 8:1.

9. The method of claim 8, wherein the ratio of water to the batch comprises about 4.5:1.

10. The method of claim 1, wherein the kettle further comprises an agitator, and, prior to adding the explosive material, establishing an agitator speed of from about 45 rpm to about 55 rpm, and, after adding the explosive material, agitating for about 10 minutes to about 30 minutes at ambient temperature.

11. The method of claim 1, wherein the explosive material is selected from the group comprising HMX, RDX, and TATB.

12. The method of claim 1, further comprising, prior to adding the lacquer, establishing the agitator speed at about 70 rpm to about 75 rpm, and, after adding the lacquer, agitating for about 30 minutes to about 60 minutes at ambient temperature.

13. The method of claim 1, wherein the heating step includes maintaining the contents of the kettle above about 98 degrees C. for about 10 minutes to 30 minutes.

14. The method of claim 1, wherein the step of adding the lacquer comprises slowly adding the lacquer over about 10 minutes to about 30 minutes.

15. The method of claim 1, wherein the contents are cooled from about 45 degrees C. to about 55 degrees C.

16. The method of claim 1, wherein after the cooling step, the agitator speed is slowed to about 40 rpm to about 55 rpm.

17. The method of claim 1, wherein the drying step includes drying the explosive material until a moisture content comprises less than about 0.1%.

18. The method of claim 1, wherein prior to adding the lacquer, the explosive material and water are heated from about 50 degrees C. to about 64 degrees C.

* * * * *

UNITED STATES PATENT AND TRADEMARK OFFICE

CERTIFICATE OF CORRECTION

PATENT NO. : 6,485,587 B1
DATED : November 26, 2002
INVENTOR(S) : Han, Phillip S.

It is certified that error appears in the above-identified patent and that said Letters Patent is hereby corrected as shown below:

Title page,
Item [75], Inventor, "Philip S. Han" should read -- Phillip S. Han --.

Signed and Sealed this

Sixth Day of May, 2003

JAMES E. ROGAN
*Director of the United States Patent and Trademark Office*